United States Patent [19]

Giattino

[11] 4,013,012

[45] Mar. 22, 1977

[54] ELECTRONIC SAFE ARMING AND FUZING SYSTEM

[75] Inventor: Louis Robert Giattino, Hollister, Calif.

[73] Assignee: Altus Corporation, Cupertino, Calif.

[22] Filed: Nov. 18, 1974

[21] Appl. No.: 524,558

[52] U.S. Cl. ..... 102/70.2 R

[51] Int. Cl.[2] ..... F42C 15/40

[58] Field of Search ..... 102/70.2 R

[56] References Cited

UNITED STATES PATENTS

| | | | |
|---|---|---|---|
| 2,889,777 | 6/1959 | Rabinow | 102/70.2 R |
| 2,906,206 | 9/1959 | Morison et al. | 102/70.2 R |
| 3,067,684 | 12/1962 | Euker et al. | 102/70.2 R |
| 3,088,409 | 5/1963 | Yavelberg | 102/70.2 R |
| 3,752,081 | 8/1973 | McKeown et al. | 102/70.2 R |
| 3,804,020 | 4/1974 | Norton | 102/70.2 R |
| 3,880,082 | 4/1975 | Chernoff | 102/70.2 R |
| 3,890,900 | 6/1975 | Gould, Jr. | 102/70.2 R |

*Primary Examiner*—Charles T. Jordan
*Attorney, Agent, or Firm*—Thomas H. Williams

[57] ABSTRACT

An electronic safe arming and fuzing (ESAF) system using an accelerometer capable of sensing the acceleration of a missile and supplying an electric signal upon measuring a predetermined level of acceleration. The accelerometer signal is supplied to an electronic timer which upon the receipt of said signal initiates a timing circuit. A predetermined time after receipt of the accelerometer signal the timer causes a high voltage to be stored on a large capacitor. An electronic switch is connected between the capacitor and an exploding bridge wire detonator and will cause the energy stored in the capacitor to pass through the exploding bridge wire (EBW) upon receipt of a proper triggering signal from a trigger means. The EBW detonator is imbedded in a secondary explosive and causes said explosive to detonate without the aid of a primary explosive when said trigger signal is received.

6 Claims, 4 Drawing Figures

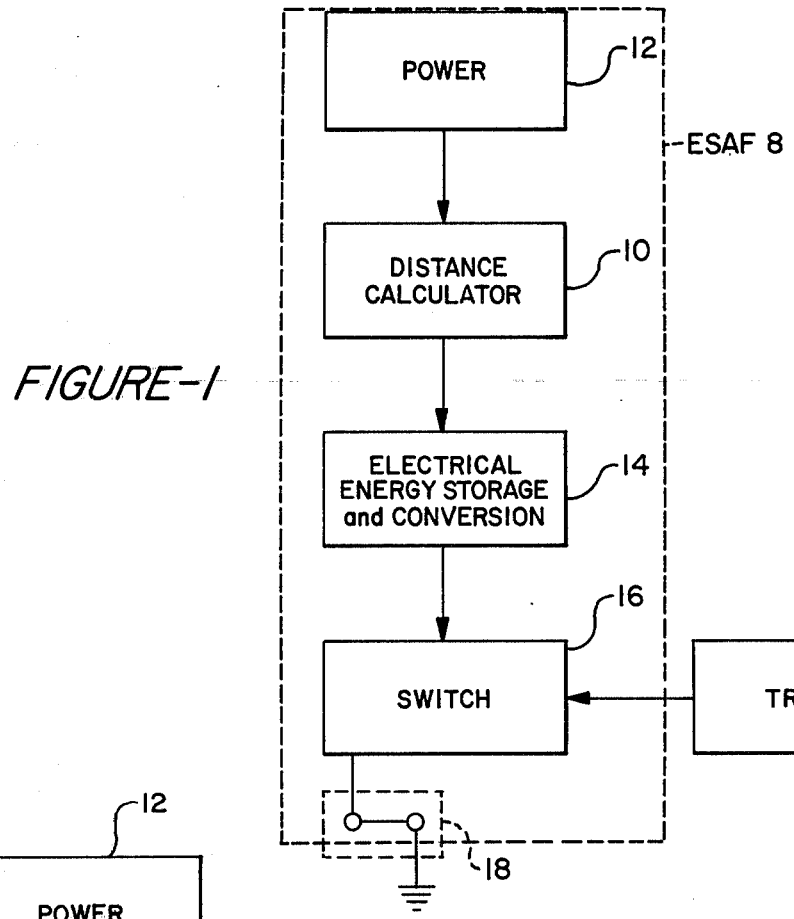
FIGURE-1
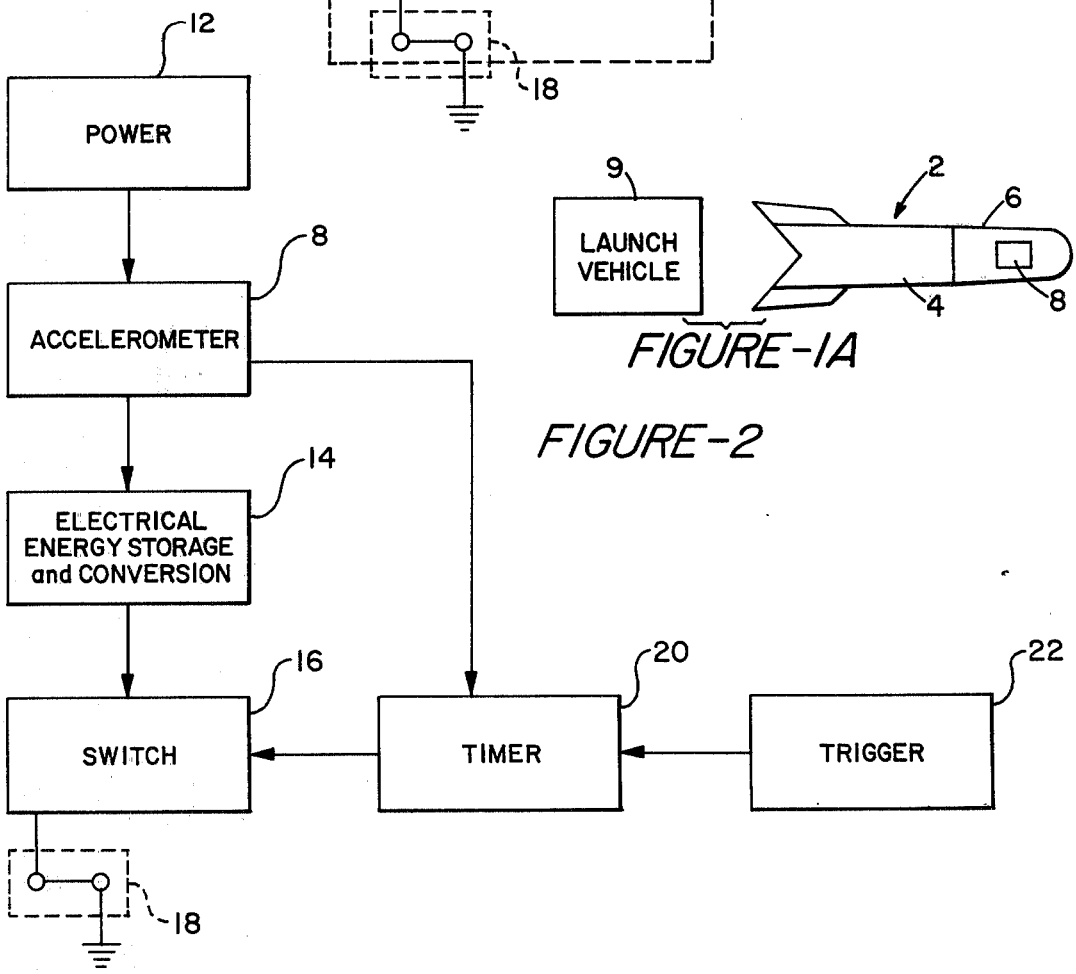
FIGURE-1A
FIGURE-2

ELECTRONIC SAFE ARMING AND FUZING SYSTEM

BACKGROUND OF THE INVENTION

The present invention relates to safe arming and fuzing systems for the detonation of explosives and propellants. More particularly, it relates to electronic safe arming and fuzing systems.

Safe arming and fuzing (SAF) systems are extensively used in missiles. The function of the SAF is to maintain the missile warhead or rocket motor in a safe condition until the missile has separated from the launch vehicle some predetermined safe distance. At this point, the SAF arms the warhead. The SAF also fires the warhead on receipt of a trigger signal from either an external source such as a contact trigger or from a backup trigger which may be integral with the SAF device.

In missiles, the warhead is made with a secondary explosive as opposed to a primary explosive. Secondary explosives are characterized by having a very high energy output and very specific conditions for detonation. For example, it typically requires $10^7$ ergs delivered in less than 1 microsecond to detonate a secondary explosive. Primary explosives, on the other hand, are very sensitive to detonation, requiring about 1000 times less energy than a secondary explosive, but have a lower energy output. Primary explosives will detonate when subjected to a spark, flame, friction, a hot wire which causes a crystal of the primary explosive to reach its ignition temperature, or mechanical shock. In contrast, secondary explosives will detonate only when subjected to a high energy shock wave. The most common way of detonating a secondary explosive is with the shock wave generated by a primary explosive.

A small charge of primary explosive and some means for causing its controlled detonation is often referred to as a primer. A good example of a primer is a blasting cap consisting of a small charge of primary explosive such as lead azide molded around a small resistance wire. When an electric current is passed through the wire, the wire heats up very fast and causes the primary explosive to detonate. If the primer is located properly with respect to a secondary explosive, detonation of the former will cause detonation of the latter. A percussion primer operates in the same manner except that impact and friction energy are used to ignite the primary explosive rather than electrical energy.

Although the use of a primer is a cheap and effective means of detonating secondary explosives, it is very hazardous. Because primary explosives are sensitive to heat and shock they are prone to exploding prematurely. For example, the mere presence of radio frequency electromagnetic energy in the area may cause the resistance wire to heat up enough to detonate the primer. In spite of the considerable hazards associated with primers, they have been and continue to be the detonator around which nearly all SAF systems are built.

In attempting to avoid the hazards of a conventional primer, existing SAF systems are built in a very special way. Fundamental to existing SAF systems is the requirement that the primer be kept "out of line" with the secondary explosive until the warhead is armed. That is, prior to arming, the primary explosive is physically separated from the secondary explosive by a heavy mechanical barrier. The arming step consists of removing the mechanical barrier between two explosive types. This is done by the actual mechanical movement of the primary explosive from behind the barrier to a position that is in line with the secondary explosive. This requires an actual mechanical movement of parts within the SAF system and accordingly requires the application of mechanical energy. Typically this is achieved by loading a spring from energy gained through the acceleration of the missile. For example, the missile acceleration places a force on a movable heavy weight which in turn cocks a spring. Energy in the spring may then be used to move the primer in line with the secondary explosive at the appropriate time.

The process of determining that the missile has reached a saft distance from the launch vehicle is typically achieved by sensing that the missile has been launched with the accelerometer, which in turn initiates a classic mechanical clock movement. After the clock has counted down its predetermined period of time, it trips the spring and causes the primary explosive to move into alignment with the secondary explosive. The warhead is then in an armed condition and can be fired by a trigger signal which heats the resistance wire and sets off the primary explosive.

Although this approach to detonating missile warheads has proved successful and has been and is used extensively, it has several disadvantages. To start with, the required mechanical movement of the primary explosive requires that the SAF system be relatively large and heavy. The shelf life of the systems is relatively short due to the aging of lubricants. The systems require very sensitive detonators for a fast response time (in the neighborhood of 100 microseconds) and thus, are susceptible to instantaneous accidental closure of the trigger. If a missile should fail to explode after it is armed, or for some other reason, it may be desirable to disarm a missile once it is armed. To do this with a conventional SAF system is extremely dangerous since an armed conventional SAF system has a primary explosive in line with a secondary explosive so that it is subject to all of the hazards of a conventional primer. It takes mechanical energy to disarm the system. Furthermore, positive action must be taken by someone such as removing the detonator from the warhead or otherwise isolating the detonator from the next element in the explosive train. This is an exceedingly dangerous task.

A related problem with existing SAF systems is their inability to once armed be reset in flight to a disarmed condition based on external information. For example, if a missile to be used in close air support goes off course, it is desirable to disarm the missile so that it will not explode among friendly troops. Existing systems are incapable of doing this because they are usually locked in the arm position and require mechanical energy and frequently acceleration to achieve a disarm position.

It is therefore an object of this invention to provide a primarily electronic SAF system;

It is a further object of this invention to provide a SAF system that will disarm itself merely by the passage of time:

It is another object of this invention to provide a SAF system that will respond to off course signals and automatically disarm itself;

It is another object of this invention to provide an extremely small SAF system:

It is another object of this invention to provide an extremely reliable SAF system;

It is still another object of this invention to provide a SAF system that is relatively cheap to manufacture; and Finally, it is an object of this invention to provide a SAF system that has a long shelf life.

SUMMARY OF THE INVENTION

These and other objects of the invention are achieved by an electronic safe arming and fuzing system using an electronic distance calculator to determine when a safe separation of the missile and launch vehicle has been achieved. At this time, said calculator causes relatively low voltage energy to be converted to a high voltage and stored in a storage means. The storage means is in turn connected through a switch to an exploding bridge wire. The switch, normally open, is closed by the receipt of a trigger signal and allows the high voltage to be impressed across the bridge wire embedded in a secondary explosive and thereby detonates said explosive without the aid of a primary explosive.

BRIEF DESCRIPTION OF THE DRAWINGS

FIG. 1A is a schematic diagram showing the setting of the present invention.

FIG. 1 is a block diagram of the basic ESAF system

FIG. 2 is a block diagram of an alternative embodiment of the invention; and

DESCRIPTION OF THE PREFERRED EMBODIMENT

Figure 3:
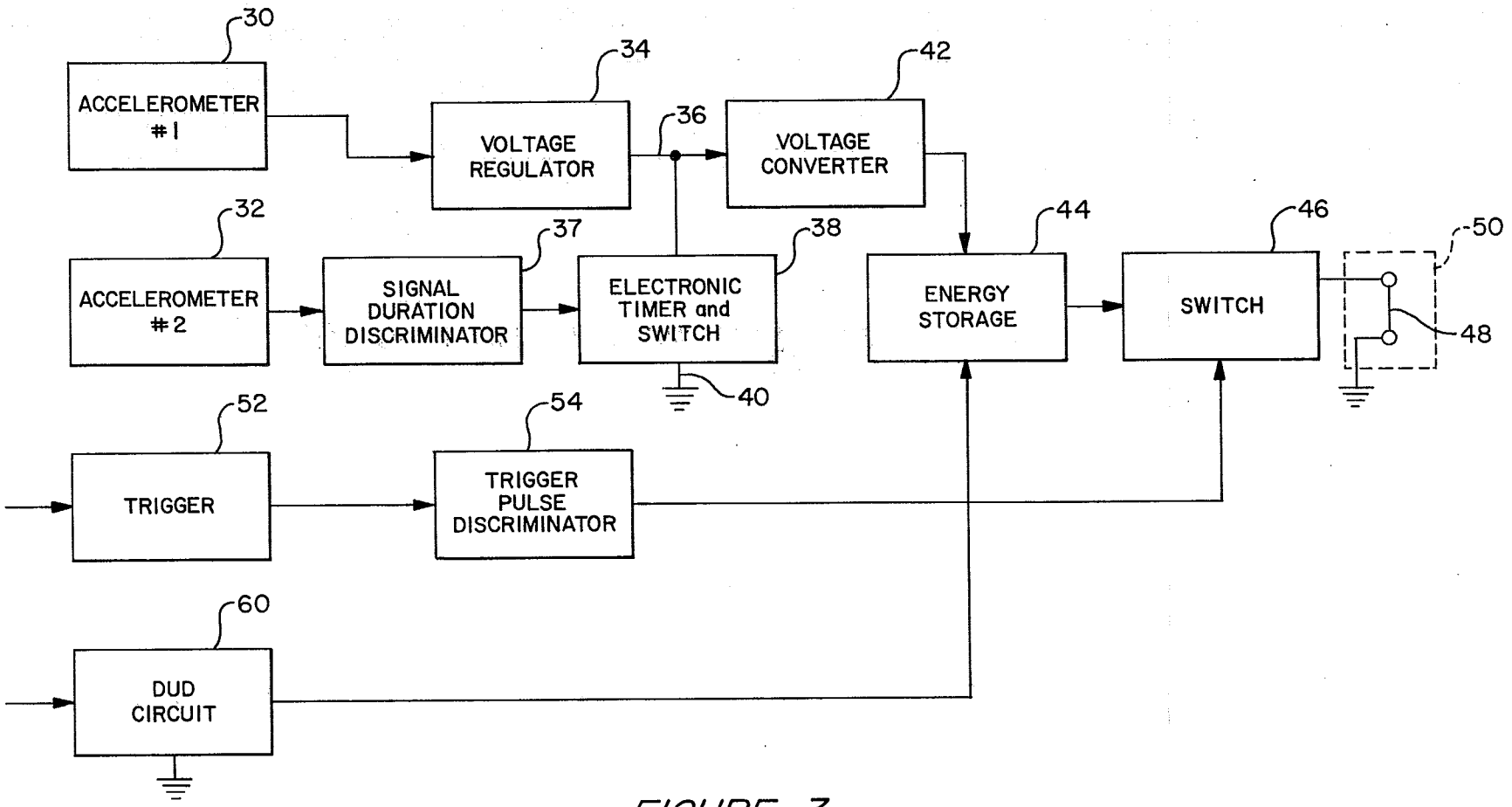
FIG. 3 is a detailed block diagram of a preferred embodiment of the invention as applied to a missile.

The setting of the invention is illustrated in FIG. 1A wherein a missile two having a rocket section 4 and a warhead section 6 with the ESAF imbedded thereon or contiguous thereto, has been launched from a launch vehicle 9 such as an aircraft, tank, ship or carriage. Referring now to FIG. 1, ESAF 8 in its basic form consists of: a power supply indicated by reference numeral 12 supplies energy to a distance calculator 10. The distance calculator, to be described in more detail later, performs the function of determining a missile's distance from a launch vehicle and prevents the flow of power to other portions of the system until a predetermined "safe" distance has been reached. Power supply 12 may be part of the ESAF or more typically it is supplied from an external supply in the missile.

After the safe distance has been reached, electrical energy is supplied from power supply 12, in this case through distance calculator 10 to electrical energy conversion and storage device 14. The storage portion of the device typically is a capacitor which is charged to some high voltage, in the neighborhood of 2000 volts. Since the power supply in a missile is usually some low DC voltage, such as 24 volts, a converter is required to step it up to 2000 volts. This is done by a conventional chopper, transformer, rectifier circuit combination, well known in the art. Energy conversion and storage device 14 is connected through a high energy switch 16 to an exploding bridge wire 18. Switch 16 is closed upon receipt of a trigger signal usually generated externally to the ESAF from a contact trigger 19. The closing of switch 16 causes the energy stored in storage device 14 to flow through exploding bridge wire 18 and thereby to detonate the explosive charge in which it is embedded.

FIG. 2 shows an alternative embodiment where the distance calculator 10 of FIG. 1 consists of an accelerometer 8 located between power unit 12 and electrical energy storage and conversion unit 14, and an electronic timer circuit 20.

If a specified acceleration is experienced for a specified time, accelerometer 8 mechanically or electrically latches and closes an electrical circuit. This allows the transfer of power from power supply unit 12 through accelerometer 8 to the remainder of the system. A Technar Inc. Model GS-5 acceleration switch is a good example of an accelerometer suitable for this purpose.

To insure that the missile reaches a safe distance from the launch vehicle, the trigger signal is locked out until a safe distance has been reached. This is achieved by the cooperative action of accelerometer 8 and timer 20. When the appropriate acceleration is detected by accelerometer 8, in addition to passing energy to energy storage device 14, a signal is also supplied to timer 20. On receipt of the accelerometer signal, timer 20 is initiated and counts down some predetermined time, whatever is deemed necessary for safe separation, at which point a circuit path is connected between trigger signal source 22 and switch 16.

At this point, the ESAF is fully armed. All that is required now to cause detonation is the generation of a triggering signal from trigger signal device 22. This would, of course, typically happen when the missile reached its target.

This embodiment would, of course, work equally well if the electronic timer circuit were located between accelerometer 8 and energy storage and conversion device 14.

An alternative embodiment of the distance calculating unit 10 consists of an accelerometer to sense acceleration of the missile and an integrator unit. Since distance is the second integral of acceleration, distance can easily be calculated. If necessary, the velocity of the launch vehicle which is known, can also be taken into account. Since the distance the launch vehicle travels is the first integral of velocity, it is easy to calculate the distance it has traveled during any time period. If the distance the launch vehicle travels from the time the missile is launched to any given point in time is subtracted from the distance the missile travels, the separation is determined as a function of time. When the safe separation is reached, the operation of the ESAF is the same as previously described in connection with other embodiments.

FIG. 3 represents an embodiment of the invention particularly useful for missiles. Referring to FIG. 3, first and second accelerometers 30 and 32 are provided. When accelerometer 30 experiences a gravitational force of sufficient magnitude, a circuit is closed and external power flows through accelerometer 30 to voltage regulator 34, whose purpose is to provide a precisely regulated output voltage at terminal 36 even though the input voltage may vary in an unknown manner over some range.

Accelerometer 32, which also closes when experiencing the same gravitational force as accelerometer 30, supplies a signal to a signal duration discriminator 37, which is well known in the art. This circuit is such that accelerometer 32 must remain closed for some predetermined period of time, for example 300 miliseconds, before a signal is passed therethrough. This avoids the possible risk of having an accidental instantaneous closing of one or both of the accelerometers which would arm the system. In other words, the system must experience at least 300 milliseconds of boost acceleration before the next step in the arming sequence will occur. If these conditions are satisfied, a signal is supplied from discriminator 37 to electronic timer and switch circuit 38. Prior to receiving a signal from accelerometer 32, switch 38 is in a conducting mode and would conduct any voltage appearing at terminal 36 through to ground 40 so that no voltage would appear at the input terminal of voltage converter 42. Upon receipt of a signal from discriminator 37, timer 38 counts down some predetermined period sufficient to allow safe separation and then removes the short circuit from point 36 to ground and allows the voltage output of regulator 34 through to voltage converter 42. This is an additional safety feature that requires both accelerometers 30 and 32 to experience closure before the system is armed. Voltage converter 42 may be a conventional circuit for converting DC voltage at one level to DC voltage at another level. As is well known in the art, these typically involve an oscillator circuit for chopping the incoming DC voltage, a transformer for transforming the chopped AC voltage, and rectifiers for reconverting the AC voltage to DC. The output of voltage converter 42 is supplied to an energy storage device 44 which is typically a large capacitor. The output voltage would be in the neighborhood of 2000 to 3000 volts.

The output of energy storage device 44 is connected through high voltage switch 46 to an exploding bridge wire 48 imbedded in secondary explosive 50.

Switch 46 is, of course, normally open and must be able to sustain the high voltages across its terminals in the open position without discharging. Typically these switches are of the gas discharge type such as thyratrons, triggered spark gaps and the like. The signal for closing switch 46 is supplied from a triggering circuit 52. The trigger signal is passed on to trigger pulse discriminator 54 which discriminates against pulses shorter than some predetermined given period, for example 50 microseconds. This feature avoids any possible false triggering once the system is armed. If, however, the signal supplied from trigger circuit 52 meets the pulse width specifications, it is passed through discriminator 54 and causes switch 46 to close. At this point the energy stored in device 44 is dumped through exploding bridge wire 48 in a very short period of time causing detonation.

Dudding circuit 60 provides the capability of disarming the system on receipt of some predetermined outside signal such as from the guidance system or clock (not shown). Upon receipt of a dudding signal, dudding circuit 60 would cause the energy in storage device 44 to be discharged to ground. For example, dudding circuit 60 may take the form of a switch normally open but closed upon the receipt of a dudding signal.

I claim:

1. A system for arming a warhead of a missile after said missile has reached a predetermined distance from a launch vehicle and detonating said warhead upon the occurrence of a triggering event, said apparatus comprising:

an exploding bridge wire imbedded in the explosive of said warhead;

a first system branch comprising:

first accelerometer means for detecting a predetermined acceleration force and closing a first switch upon experiencing said acceleration force;

voltage regulator means electrically connected to said first accelerometer means such that electric energy is supplied to said regulator means when said switch is closed;

energy conversion means connected to said regulator means for converting a relatively low direct current voltage to a relatively high direct current voltage;

capacitor means connected to the output of said converter means for storing electrical energy;

switch means connected between said energy storage means and said exploding bridge wire for allowing said stored energy to pass through said exploding bridge wire upon the occurrence of said triggering event;

a second system branch comprising:

second accelerometer means for generating an output signal upon detecting said predetermined acceleration force;

electronic timer means connected to said second accelerometer, said timer means being adapted to generate an output signal a predetermined time period after receiving the output signal from said second accelerometer means; and means interconnecting said timer means and said first system branch for preventing energy from reaching said capacitor means prior to the receipt of the output signal from said timer means.

2. The apparatus of claim 1 further characterized by a trigger pulse discrimination circuit connected to said switch means and adapted to block any triggering signal having a signal duration less than some predetermined level whereby accidental or extraneous triggering signals are avoided.

3. The apparatus of claim 1 further charaterized by a signal duration discriminator connected between said second accelerometer and said electronic timer means such that signals shorter than a predetermined time are blocked whereby accidental closures of said second accelerometer are not allowed to arm said system.

4. The apparatus of claim 1 further characterized by a dudding circuit connected to said storage device and adapted to discharge said device upon receipt of a dudding signal.

5. An apparatus for arming a warhead of a missile after said missile has reached a predetermined distance from a launch vehicle and detonating said warhead upon the occurrence of a triggering event, said apparatus comprising:

an exploding bridge wire imbedded in said warhead;

means for storing electrical energy;

switch means interconnecting said exploding bridge wire and said energy storage means capable of passing said electrical energy to said exploding bridge wire upon the occurrence of said triggering event;

energy conversion means for converting relatively low voltage electrical energy to relatively high voltage electrical energy, said conversion means operatively connected to said energy storage means;

an accelerometer for sensing acceleration of said missile and generating an output signal proportional thereto;

integrating means connected to said accelerometer for integrating said output signal and thereby supplying a signal proportional to the distance said missile has traveled; and means connecting said integrating means to said energy storage means for preventing the accumulation of electrical energy in said storage means until a predetermined distance is reached.

6. An apparatus for arming a warhead of a missile after said missile has reached a predetermined distance from a launch vehicle and detonating said warhead upon the occurrence of a triggering event, said apparatus comprising:

an exploding bridge wire imbedded in said warhead;

means for storing electrical energy;

switch means interconnecting said exploding bridge wire and said energy storage means capable of passing said electrical energy to said exploding bridge wire upon the occurrence of said triggering event;

energy conversion means for converting relatively low voltage electrical energy to relatively high voltage electrical energy, said conversion means operatively connected to said energy storage means;

an accelerometer for sensing acceleration of said missile and generating an output signal proportional thereto;

timing means connected to said accelerometer for providing an output signal a predetermined time after the receipt of said output signal from said accelerometer; and means responsive to the output signal from said timing means for preventing the accumulation of electrical energy in said storage means prior to the receipt of said output signal.

* * * * *